US009061167B2

(12) United States Patent
Delgado, Jr.

(10) Patent No.: US 9,061,167 B2
(45) Date of Patent: Jun. 23, 2015

(54) FIRE EXTINGUISHER WITH DISPOSABLE PLASTIC CONTAINER

(76) Inventor: Augusto de Jesus Delgado, Jr., Goiania (BR)

( * ) Notice: Subject to any disclaimer, the term of this patent is extended or adjusted under 35 U.S.C. 154(b) by 677 days.

(21) Appl. No.: 12/593,876

(22) PCT Filed: Mar. 28, 2008

(86) PCT No.: PCT/BR2008/000114

§ 371 (c)(1),
(2), (4) Date: Sep. 29, 2009

(87) PCT Pub. No.: WO2008/119147

PCT Pub. Date: Oct. 9, 2008

(65) Prior Publication Data

US 2010/0108333 A1 May 6, 2010

(30) Foreign Application Priority Data

Mar. 29, 2007 (BR) ..... 0702725

(51) Int. Cl.

| | |
|---|---|
| ***A62C 11/00*** | (2006.01) |
| ***A62C 13/62*** | (2006.01) |
| ***A62C 13/64*** | (2006.01) |
| ***A62C 13/00*** | (2006.01) |
| ***A62C 13/76*** | (2006.01) |
| ***A62C 37/50*** | (2006.01) |
| ***A62C 13/78*** | (2006.01) |
| *F17C 1/16* | (2006.01) |

(52) U.S. Cl.

CPC . *A62C 13/76* (2013.01); *F17C 1/16* (2013.01); *A62C 13/64* (2013.01); *A62C 13/62* (2013.01); *A62C 13/78* (2013.01)

(58) Field of Classification Search

CPC ..... A62C 13/62; A62C 13/64; A62C 13/76; A62C 13/78; F17C 1/16

USPC ..... 169/30, 71–88, 89; 252/2–8.05; 220/669, 671

See application file for complete search history.

(56) References Cited

U.S. PATENT DOCUMENTS

| | | | | |
|---|---|---|---|---|
| 2,118,593 | A * | 5/1938 | Dodelin | 169/87 |
| 3,719,232 | A * | 3/1973 | Gubela | 169/88 |
| 3,827,502 | A * | 8/1974 | Lockwood | 169/51 |
| 4,567,948 | A * | 2/1986 | Roznicki | 169/76 |
| 4,787,460 | A * | 11/1988 | Clarkson | 169/51 |
| 4,854,343 | A * | 8/1989 | Rilett | 137/543.19 |
| 5,647,503 | A * | 7/1997 | Steele et al. | 220/589 |
| 5,676,210 | A * | 10/1997 | Sundholm | 169/9 |
| 6,090,465 | A * | 7/2000 | Steele et al. | 428/102 |
| 6,131,667 | A * | 10/2000 | Jesadanont et al. | 169/89 |
| 6,499,646 | B1 * | 12/2002 | Jaidka | 228/104 |
| 6,672,468 | B1 * | 1/2004 | Mount et al. | 215/42 |

(Continued)

*Primary Examiner* — Len Tran
*Assistant Examiner* — Alexander Valvis
(74) *Attorney, Agent, or Firm* — B. Aaron Schulman, Esq.; Stites & Harbison, PLLC.

(57) ABSTRACT

Fire extinguisher with disposable plastic container refers to a disposable fire extinguisher that works with direct pressure (internal) in a Container (01) manufactured with high viscosity Polyamide, Fiberglass and mineral elements composed by calcium, aluminum, magnesium, phosphorus, sodium, titanium, iron, potassium, zinc, strontium, copper, manganese and chrome, besides others for U.V protection, with a five millimeters thick Wall (P) and cylindrical shape extremities with an 180° Angle (G) ray, and Ribs (N) from plastic concentration at the welded areas.

8 Claims, 6 Drawing Sheets

(56) References Cited

U.S. PATENT DOCUMENTS

| | | | | |
|---|---|---|---|---|
| 7,082,999 | B2 * | 8/2006 | Arnot | 169/30 |
| 7,169,214 | B2 * | 1/2007 | Kubo et al. | 96/108 |
| 7,244,778 | B2 * | 7/2007 | Choate et al. | 524/395 |
| 7,367,724 | B2 * | 5/2008 | Matsushita et al. | 396/529 |
| 7,793,737 | B2 * | 9/2010 | Rouosseau et al. | 169/71 |
| 7,878,259 | B2 * | 2/2011 | Gauthier | 169/77 |
| 2005/0284966 | A1 * | 12/2005 | DeFrank | 239/542 |
| 2006/0131034 | A1 * | 6/2006 | Lahouati | 169/30 |

* cited by examiner

Figura 01
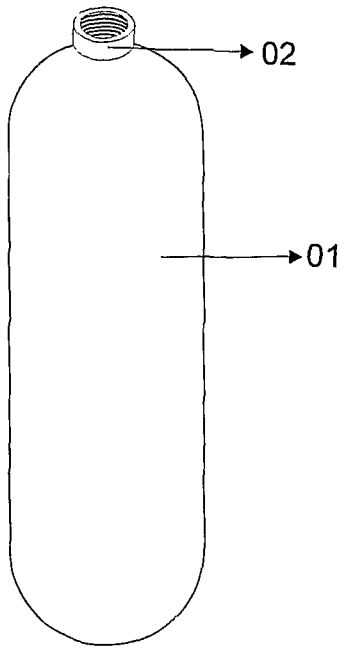
Figura 02
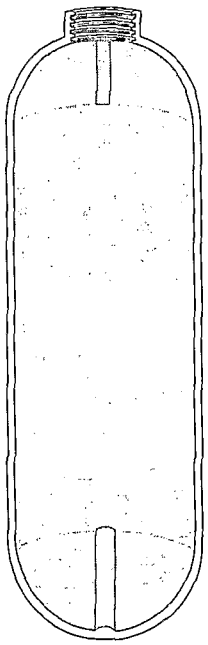

Figura 03
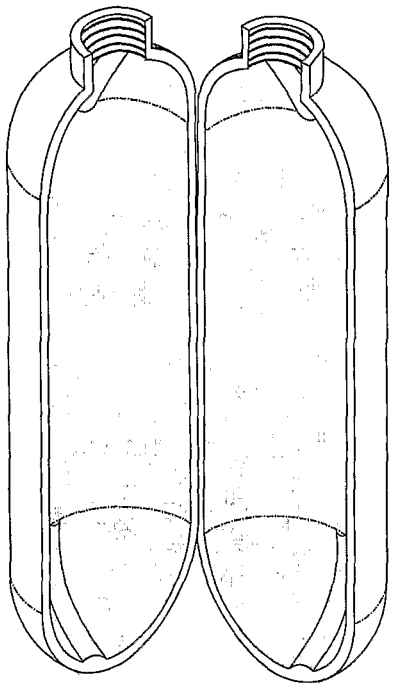
Figura 04
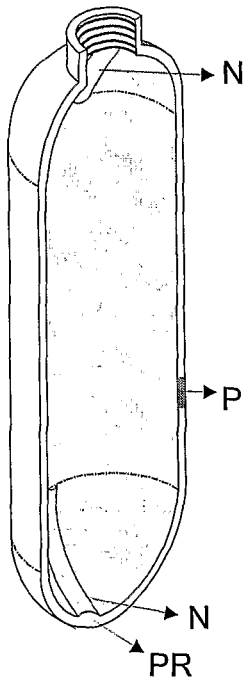

Figura 05
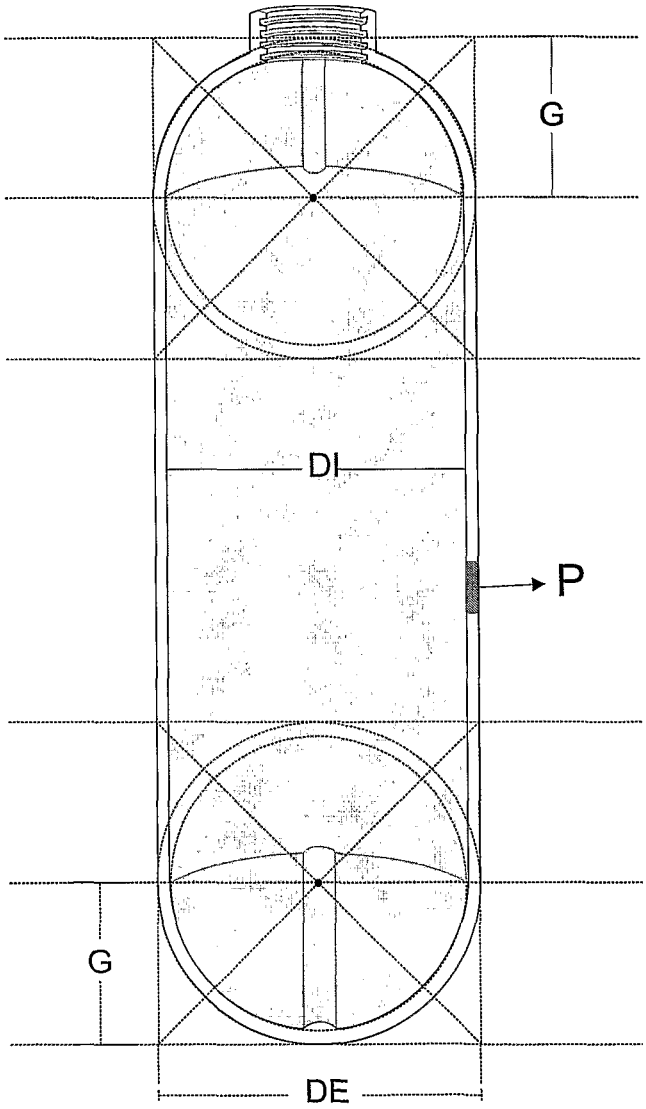

Figura 06
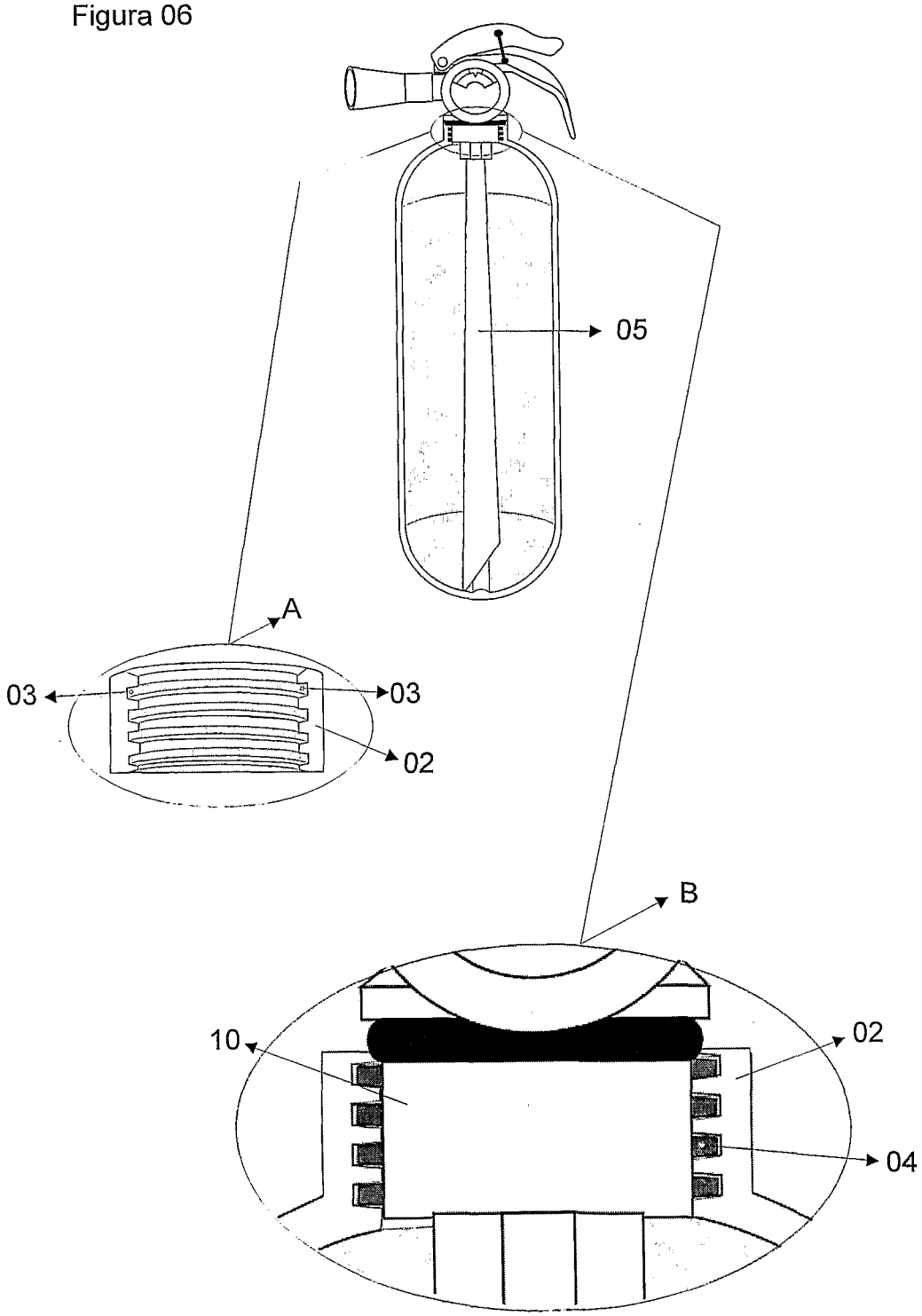

Figura 07
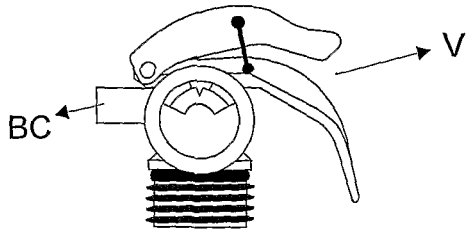
Figura 08
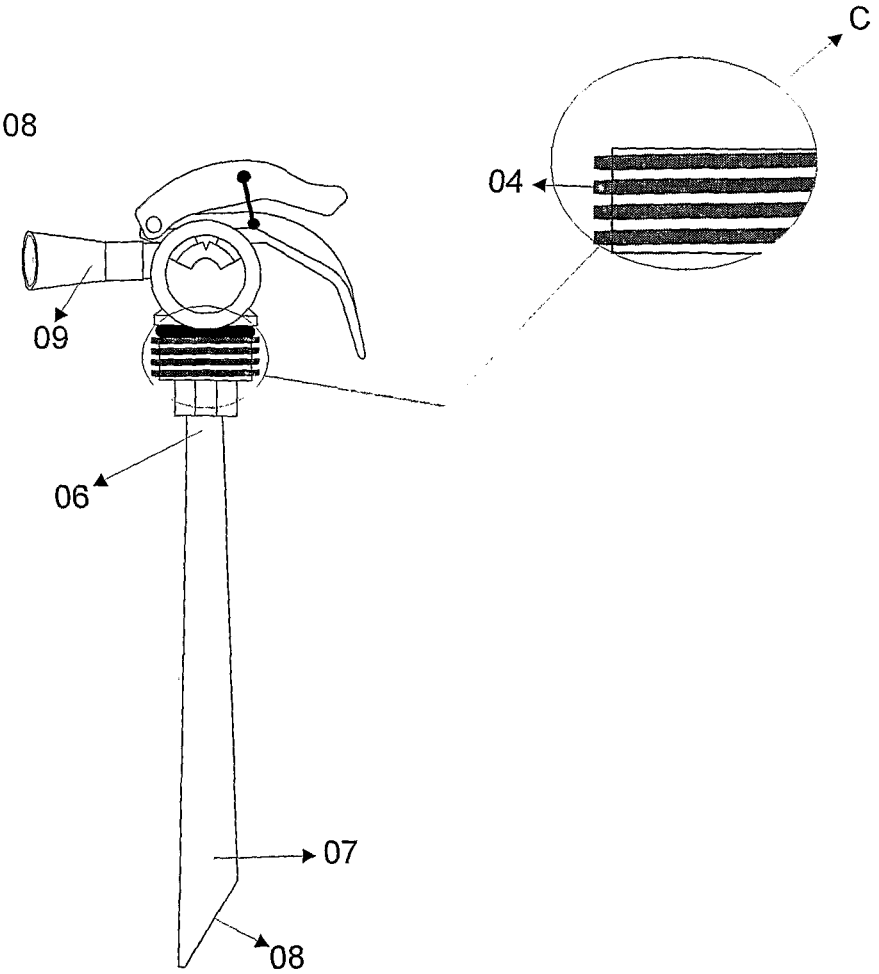

Figura 09
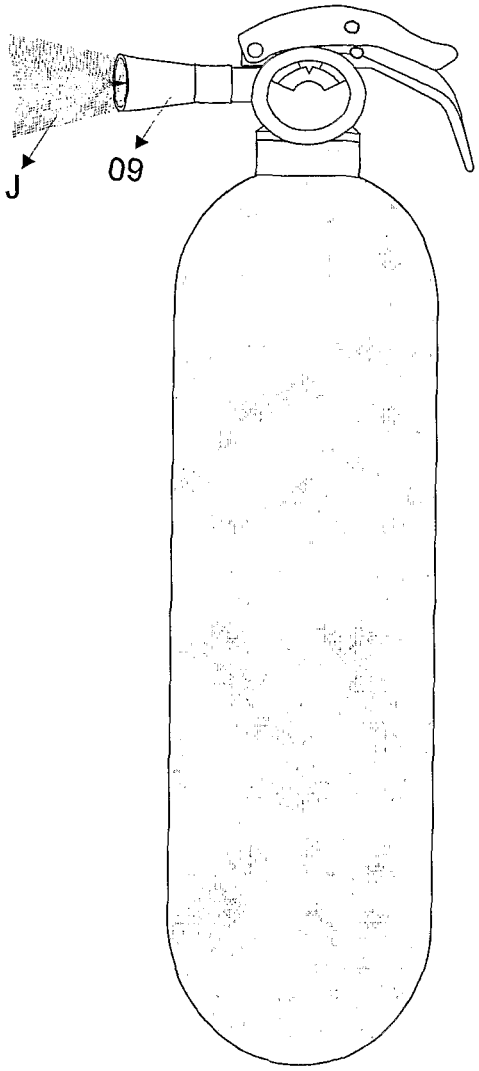

FIRE EXTINGUISHER WITH DISPOSABLE PLASTIC CONTAINER

Refers the present invention to a Fire Extinguisher manufactured with an internal plastic Container from an engineering combination process and composite of a high viscosity Polyamide, Fiberglass and minerals, with mechanical resistance characteristics similar to steel, able to support the internal pressure and external impacts.

There was found the patent EP-0283568 and the U.S. Pat. No. 4,854,343, and they both refer to fire extinguishers, and it was possible also verify that these two patents glimpsed the possibility to manufacture such extinguishers in metallic material and/or plastics, however, it is known that until then it was not possible the development of a plastic Container capable to support the internal pressure caused by the components such as the chemical powder among others or pressures caused by external impacts.

In the U.S. Pat. No. 4,854,343 can be noticed that the used physical shape of the Container (cylindrical tube) has a minimum angle for the rounded corners on the inferior and superior parts, according to the illustrations 1 and 4 of the referred patent. This fact allied to the lack of a plastic to support high pressures, contributed in a way it was not possible the production of a fire extinguisher in plastic material but only in metal as steel carbon or aluminum, so that the Container of cylindrical shape presented and the lack of an appropriate plastic (polymer), frustrated the manufacture of fire extinguishers with plastic Container.

As to the patent EP-0283568, it presented a constructive disposition that would make possible the production of fire extinguishers in plastic material, by the fact this patent foresees that inside of the Receptacle (1) there would be a Bottle-flask (11) so that the necessary pressure to expel the fire extinguishing product, would not be inside the plastic Receptacle (1), but in the bottle-flask (11) with the purpose to blow out the said fire extinguishing product, what would be a very complex fire extinguisher in terms of production and assembly, besides being very expensive due to the great number of components and the purpose of the plastic Receptacle (1), would be pure and simply to store the extinguishing product and not to support the direct pressure as it is the case of regular fire extinguishers, as well as the extinguisher that is object of this present invention, in other words, the object of the patent EP-0283568 glimpsed the possibility to manufacture extinguishers of plastic using a system of indirect pressurization, commonly used in steel extinguishers.

As described, the two systems didn't prosper with this sort of plastic Container due to the presented difficulties, but this present invention innovates building a plastic Container manufactured with of high viscosity Polyamide, Fiberglass and minerals, of cylindrical shape, differentiated from the existing extinguishers found in the state of technique, in the sense that the Container could support besides a variable thermal resistance, also great loads of internal pressure and external aggressions, also with the advantage of being the plastic many times lighter than steel, making this Fire Extinguisher a lot lighter than the conventional ones made of steel, being such Container susceptible to recycling for the production of new ones avoiding aggressions to the environment, contributing for the partner-environmental echo-efficiency. With the purpose of solving such inconveniences and difficulties the present invention was developed also with colored plastic pigmentation that will facilitate color variations in agreement to the consumer's need and to technical standards, although the plastic Container presented here is in red, due to the effective safety standards. The referred plastic Container has chemical and mechanical resistance superior to those of steel with the benefit of not being corrosive and susceptive to rust, or plastic alterations in behavior, supporting exposition to chemical products or others and resistant to ultra-violet light (U.V), maintaining the color stability on the extinguisher, and the present invention will be better understood in consonance with the annex illustrations where:

The FIG. 1 displays a perspective view of the plastic Container of the present invention.

The FIG. 2 displays an up strait cut of the plastic Container making possible an internal visualization.

The FIG. 3 displays a sidelong cut of the plastic Container in two halves.

The FIG. 4 displays in perspective a straight cut of the plastic Container.

The FIG. 5 displays the same view of Illustration 2 however with schematic details of the round shape applied to the extremities of the plastic Container.

The FIG. 6 displays the assembled Fire Extinguisher with the action Valve, and a straight cut of the plastic Container, besides two details (A and B) enlarged for a better understanding.

The FIG. 7 displays a front view of the action Valve traditionally used in regular fire extinguishers.

The FIG. 8 displays the transport group of the fire extinguishing product, showing an enlarged detail (C) of the external Thread. The Illustration 9 shows the Fire Extinguisher properly mounted and simulation of action.

As can be seen on the Illustrations, there is a plastic Container (01) with a Mouthpiece (02) with internal Threads (03) to receive external Threads (04) located at the base (10) of the Valve (V); and also a conductive Tube (05) outlet for the fire extinguishing content.

To build a Fire Extinguisher manufactured with a plastic Container was necessary to ally the plastic production technology to provide the supporting resistance, besides the internal pressure (once the international standards dictates that the pressure should be enough to expel the whole content of the fire extinguishing product in a determined time) and external aggressions (so the fire Extinguisher doesn't break with impacts with occasional external aggressions, eliminating injure risks by users) to a specific cylindrical shape with maximum reduction of the internal mechanical resistance caused by the straight and semi-straight corners (sharp corners).

Thus, by the use of a raw material technologically denominated Engineering Polymer, of high viscosity Polyamide, Fiberglass and traces of the following minerals: silicon, calcium, aluminum, magnesium, phosphorus, sodium, titanium, iron, potassium, zinc, strontium, copper, manganese and chrome, as well as pigments for the definition of the color, besides supplements for U.V protection, to associate mechanical, thermal resistance being able to resist temperatures, thus solving the plastic resistance problem through the creation of this Engineering Polymer.

Besides a suitable Plastic was still necessary to manufacture a plastic Container (01) with a Wall (P) capable to offer enough resistance to support the internal pressure and external aggressions, so this wall (P) was manufactured with thickness between three and twenty millimeters, with better economical and resistance results with five millimeters for the model P1 extinguisher for small family vehicles. The same way it was also important to have it built in a cylindrical shape to reduce to maximum the internal mechanical resistance, usually caused by sharp corners, and it was solved by manufacturing the said plastic Container (01) with both extremities in total cylindrical shape, where independently of the external Diameter (DE) and internal Diameter (DI) the extremities will have an 180° Angle (G) ray, eliminating rupture risks in these ends that are usually critic.

In the plastic Container process of production of the present invention, it was necessary besides overcoming the difficulties mentioned above, there was also the need to have enough welding resistance on the region between the cut made by the mold head on each, inferior (bottom) and superior (Mouthpiece), cylindrical extremities. For that, it was necessary to provide means to weld the extremities of the plastic container in a way that where the wall was cut, it was welded through the union of one wall to the other, causing a fusion with a little excess of plastic in that local in a way the plastic Container wall becomes thicker in that spot, forming a small Rib (N) on both inferior and superior parts, with plastic concentration in this rib of something between ten and a hundred percent of the thickness of the Wall (P) being twenty percent the ideal, although tests have proved that it could have the same thickness of the said Wall (P), and this procedure eliminates the difficulty to provide resistance on junctions of the plastic Container cut (01).

Another problem to be solved for the Extinguisher to become viable was that, being the Container (01) and the Valve (V) made of plastic, there was a possibility that the said Container (01) could be reutilized and recharged by companies without any commitment with quality and safety (the reutilization and recharge is not allowed by the effective norms), offering the risk of having the Valve (V) unscrewing with little effort while the extinguisher is still pressurized, and to prevent that, the innovation of present claim is the that the external Thread (04) of the Valve (V) is welded to the internal Thread (03) of the Mouthpiece (02) through a process of molecular fusion by laser welding, making of them a single unit. This procedure makes impracticable any reutilization attempt as much of the Valve (V) as of the plastic Container (01) making of them disposable parts, that could only be recycled, ensuring that they would not be reused following the vehicles fire extinguishers regulation norms.

As described, only the high resistance of the plastic polymer would not be enough to make possible the manufacturing of a fire extinguisher with internal plastic Container using the same cylindrical configurations presented in extinguishers found in the state of technique and the same direct pressure system, in other words, the pressure inside the Container without using a Bottle flask with indirect pressurization.

For a practical use of the present plastic Extinguisher, the conductor Tube (05), that drives out the fire extinguishing product, will have its inferior Base (07) practically of the same diameter of the Mouthpiece (02), being so larger than the superior outlet (06) besides containing the entrance Mouth (08) of diagonal cut, as well as the outlet mouthpiece of the valve (09) which funnel shape to propitiate a better aiming of the fire extinguishing product.

As expected, a plastic Extinguisher of such characteristics can be made to store different loads of fire extinguishing product as convenient to every commercial and residential building or industrial plant, among others.

The invention claimed is:

1. A fire extinguisher device comprising:

a container (01) for a fire extinguishing material, the container having a generally cylindrical body defining a longitudinal axis thereof, an upper extremity, a lower extremity, an upper junction joining the cylindrical body to the upper extremity and a lower junction joining the cylindrical body to the lower extremity;

wherein the container comprises an external wall (P) having a thickness of from 3 millimeters to 20 millimeters, wherein the external wall has an interior surface and an exterior surface, and wherein the container defines an interior diameter (DI) between diametrically opposed points on the interior surface of the cylindrical body, and an exterior diameter (DE) between diametrically opposed points on the exterior surface of the cylindrical body;

wherein each of the upper extremity and the lower extremity is hemispherical in shape and defines a radius (G), wherein the radius (G) forms an angle of 180° at the interior diameter and at the exterior diameter at each of the upper junction and the lower junction;

wherein the external wall comprises a material comprising high viscosity polyamides, fiberglass, at least one pigment, at least one UV protective supplement and at least one mineral element selected from silicon, calcium, aluminum, phosphorus, magnesium, sodium, titanium, iron, potassium, zinc, strontium, copper, manganese and chromium;

wherein the upper extremity comprises an opening (02) having a diameter and an internal thread (03);

a valve (V) comprising a base (10) having an external thread (04), wherein the base is received in the opening (02) of the upper extremity, and the external thread couples with the internal thread, wherein the coupled internal thread and external thread are welded together by laser welding forming a fused portion, said fused portion prevents the device from being reused or recharged; and an outlet tube (05) extending from the base of the valve into the container along the longitudinal axis of the container, the outlet tube having a first open end (06) proximal to the base of the valve and a second open end (07) distal to the base of the valve.

2. The fire extinguisher device according to claim 1 where the thickness of the external wall is 5 millimeters.

3. The fire extinguisher device according to claim 1, wherein each of the upper extremity and the lower extremity comprises a rib (N) formed on the interior surface of the external wall, wherein the rib is aligned with the longitudinal axis of the container, and wherein the rib has a thickness of from 10% to 100% of the thickness of the external wall.

4. The fire extinguisher device according to claim 3, where the thickness of the rib is 20% of the thickness of the external wall.

5. The fire extinguisher device according to claim 1, wherein:

the first open end (06) of the outlet tube defines a first cross-sectional diameter in a first cross-sectional plane oriented perpendicular to the longitudinal axis of the cylindrical body;

the second open end (07) of the outlet tube defines a second cross-sectional diameter in a second cross-sectional plane oriented parallel to the first cross-sectional plane;

the second cross-sectional diameter is at least equal to the diameter of the opening (02) of the upper extremity and the second cross-sectional diameter is larger than the first cross-sectional diameter;

the second open end has an opening (08) oriented diagonally to the longitudinal axis of the container; and the valve further comprises a funnel-shaped outlet (09) in fluid communication with the outlet tube, for directing a flow of fire extinguishing material exiting the device.

6. The fire extinguisher device according to claim 5, wherein each of the upper extremity and the lower extremity comprises a rib (N) formed on the interior surface of the external wall, wherein the rib is aligned with the longitudinal axis of the container, and wherein the rib has a thickness of from 10% to 100% of the thickness of the external wall.

7. The fire extinguisher device according to claim 1, further comprising the fire extinguishing material.

8. The fire extinguisher device according to claim 3, further comprising the fire extinguishing material, wherein the fire extinguishing material is pressurized.

* * * * *